United States Patent [19]

Hoebel

[11] Patent Number: 4,947,566

[45] Date of Patent: Aug. 14, 1990

[54] PHOTOGRAPH MAILING UNIT

[76] Inventor: Michael D. Hoebel, 116 Calvin Ct. North, Tonawanda, N.Y. 14150

[21] Appl. No.: 266,218

[22] Filed: Oct. 28, 1988

Related U.S. Application Data

[63] Continuation of Ser. No. 616,707, Jun. 4, 1984, abandoned.

[51] Int. Cl.[5] ..... A47G 1/06; G09F 1/12

[52] U.S. Cl. ..... 40/158.1; 40/152.1; 229/92.8

[58] Field of Search ..... 40/152.1, 152, 155, 40/156, 158.1, 159, 124.4, 124.1; 248/459; 229/92.8, 82

[56] References Cited

U.S. PATENT DOCUMENTS

| | | | |
|---|---|---|---|
| 687,411 | 11/1901 | Stuparich | 40/158 R |
| 816,870 | 4/1906 | Markoff | 40/158 R |
| 878,556 | 2/1908 | Palm, Jr. | 229/92.8 |
| 1,803,511 | 5/1931 | Shanholtzer | 248/459 |
| 2,030,135 | 2/1936 | Carpenter | 40/594 |
| 2,045,944 | 6/1936 | Domke | 229/92.8 |
| 2,256,399 | 9/1941 | MacHarg | 229/92.8 |
| 2,805,816 | 9/1957 | Morgan | 229/92.8 |
| 3,191,327 | 6/1965 | Neff | 248/459 |
| 3,346,172 | 10/1967 | Tucker | 229/92.8 |
| 3,355,828 | 12/1967 | Betz | 40/152.1 |
| 3,545,115 | 12/1970 | Nichols | 40/152.1 |
| 3,677,399 | 7/1972 | Tatar | 229/92.8 |
| 3,847,325 | 11/1974 | Nasacski et al. | 40/158 R |
| 3,986,283 | 10/1976 | Pelaez | 40/158 R |
| 4,079,881 | 3/1978 | Sabb | 40/158 R |
| 4,167,241 | 9/1979 | Zumbrunn | 40/152.1 |
| 4,442,617 | 4/1984 | Frye et al. | 40/152.1 |

OTHER PUBLICATIONS

"Photo Card", Exhibits A & B as submitted by the applicant, ©1982.

*Primary Examiner*—Kenneth J. Dorner
*Assistant Examiner*—J. Hakomaki
*Attorney, Agent, or Firm*—Hodgson, Russ, Woods, Andrews & Goodyear

[57] ABSTRACT

A photograph mailing and display unit and an associated method of constructing the same utilizes a relatively rigid panel or card material having a central portion and a marginal portion which are foldably movable relative to one another to a condition at which the panel provides an easel. A coating of adhesive overlies a substantial portion of the marginal portion of the panel, and a border panel overlies and is in contact with the adhesive coating. The border panel defines a central cutout within which a photograph can be positioned and provides a mat for the photograph.

1 Claim, 1 Drawing Sheet

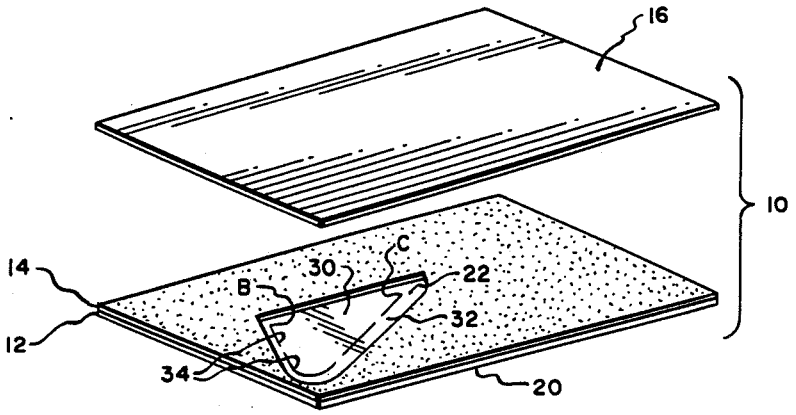
Fig. 1.
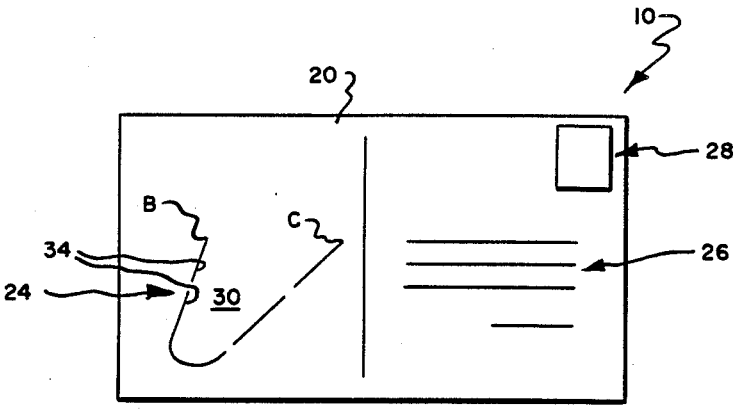
Fig. 2.
Fig. 3.
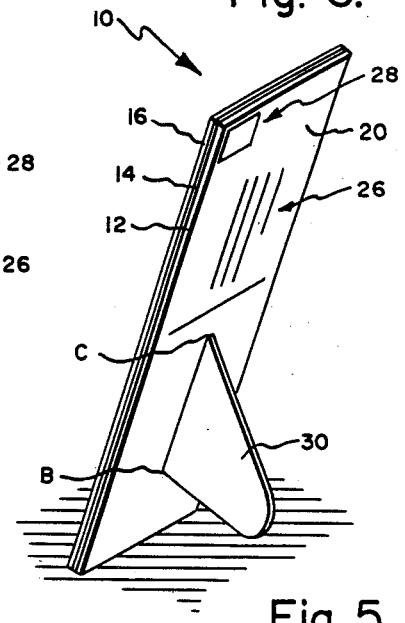
Fig. 4.
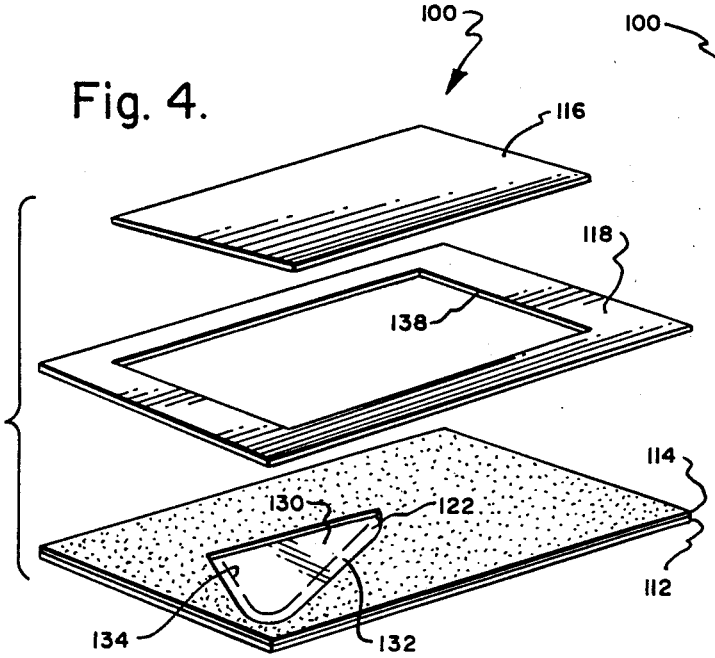
Fig. 5.
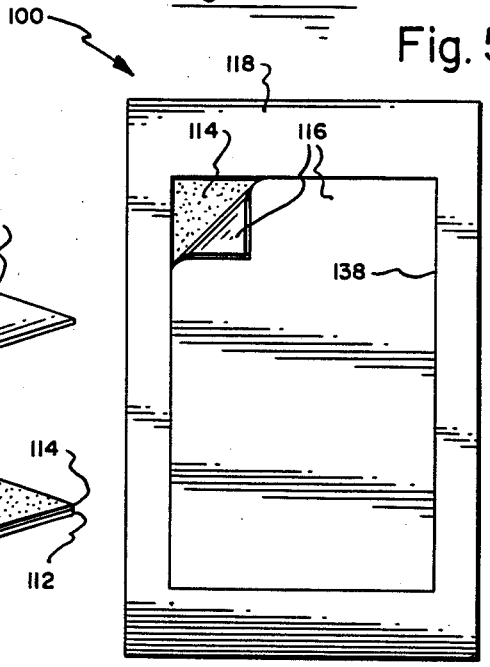

PHOTOGRAPH MAILING UNIT

This application is a continuation of application Ser. No. 616,707, filed June 4, 1984 now abandoned.

BACKGROUND OF THE INVENTION

This invention relates in general to a unit to which a photograph can be affixed and relates more particularly to a unit to which a photograph can be affixed for purposes of mailing and displaying the photograph.

There exists conventional units which can each be used for sending a photograph and a written message through the mail and each of which is convertible to an easel for supporting the mailed photograph for viewing. When such a conventional unit, with photograph and message, is received by an addressee, the addressee can use the unit to display the photograph. An example of such a unit is shown and described in U.S. Pat. No. 3,174,244.

It is an object of the present invention to provide a new and improved unit for mailing and displaying a photograph and to which a written message can be applied.

Another object of the present invention is to provide such a unit which is convertible into an easel to support the photograph for viewing.

Still another object of the present invention is to provide such a unit which can be constructed easily and economically.

Yet still another object of the present invention is to provide a method of constructing such a unit.

SUMMARY OF THE INVENTION

This invention resides in a unit for mailing and displaying a photograph and in a method of constructing such a unit.

The unit of this invention includes a relatively rigid panel and a coating of adhesive. The relatively rigid panel has a writing surface on one side thereof and defines a central portion and a marginal portion. The central portion is bordered by the marginal portion and is foldably movable relative thereto between a first condition at which the central portion and the marginal portion are coplanar and a second condition at which the central portion extends angularly from the one side of the panel so that when positioned in the second condition, the central and marginal portions provide an easel. The coating of adhesive is layered upon the other side of the panel so as to cover a substantial portion of the marginal portion thereof.

The method of this invention includes the steps involved in constructing the unit of this invention. Such steps include providing the relatively rigid panel of the unit of the invention and coating the other side of the relatively rigid panel with a layer of adhesive so that the coating overlies a substantial portion of the panel marginal portion.

BRIEF DESCRIPTION OF THE DRAWINGS

FIG. 1 is a perspective view of an embodiment of the unit of this invention, shown before completed assembly.

FIG. 2 is a plan view of the side of the FIG. 1 unit upon which a message can be written.

FIG. 3 is a perspective view of the FIG. 1 unit in the form of an easel.

FIG. 4 is a perspective view of another embodiment of the unit of this invention, shown before completed assembly.

FIG. 5 is a plan view of the unit of FIG. 4 as seen from the side against which a photograph can be mounted but showing the adhesive protective backing material partially removed.

DETAILED DESCRIPTION OF ILLUSTRATIVE EMBODIMENTS

Turning now to the drawings in greater detail, there is shown in FIG. 1 an embodiment of a unit, generally indicated 10, in accordance with the present invention. The unit 10 includes a relatively rigid panel 12 and a coating 14 of adhesive. Utilized with the unit 10 is a releasable backing material or sheet 16. As will be explained in detail hereinafter, the components 12,14 and 16 of the unit 10 are assembled generally in a layered or layup arrangement.

The panel 12 is rectangular in shape and comprised of a relatively rigid card material. It has been found that a card material having a thickness of 16 mills is well-suited for use as the panel 12. The boundary edges of the panel 12 have dimensions which conform to post office standards and which are substantially the same as, but no less than, the dimensions of the edges of the photograph to be mounted upon the unit 10.

The panel 12 has two sides 20 and 22. One side 20, or the lower side as shown in FIG. 1, has a surface which is adapted to receive a written message such as may be applied with a pen or pencil. As best shown in FIG. 2, the one side 20 of the panel 12 bears indicia, as does a common postcard, denoting regions 24,26 and 28. Region 24 indicates the surface space upon which a message is normally applied; region 26 indicates the space upon which the unit 10 is addressed; and region 28 denotes the space upon which the postage stamp is normally applied Referring again to FIG. 1, the panel 12 defines a central tongue portion 30 and a marginal portion 32 bordering the central portion 30. Along a portion of the boundary of the central portion 30 is defined a series of cuts or slits 34,34 as shown. The two ends of the series of slits 34,34 are indicated B and C. The slits 34,34 are positioned in an end-to-end arrangement and each slit 34 is separated from its adjacent slit 34 by a small uncut segment. The series of slits 34,34 outline a substantially V-shaped tongue which, as shown in FIG. 1, is coplanar with the panel marginal portion 32. The slitted boundary of the central portion 30 can be easily separated or torn from the panel marginal portion 32 to thereby permit the central portion 30 and marginal portion 32 to be folded relative to one another along a line extending between ends B and C to a condition, as shown in FIG. 3, at which the central portion extends angularly away from the one side 20 of the panel 12. It will be understood that the central portion 30 is of such size and shape that when folded relative to the marginal portion 32 so as to extend angularly therefrom, the central portion 30 and the marginal portion 32 collectively provide an easel.

The coating 14 of adhesive is layered upon the other side 22 of the panel 12 so as to cover a substantial portion of the marginal portion 32, and as shown in FIG. 1, the coating 14 extends from the boundary of the central portion 30 to the boundary edges of the panel 12. No adhesive overlies the central portion 30. The adhesive material comprising the coating 14 is of sufficient quality and strength that when a photograph is placed in contact therewith, the photograph suitably adheres to the panel 12

The releasable backing sheet 16 has boundary edge dimensions which are substantially the same as those of the photograph to be mounted upon the unit 10, and is centrally positioned over the panel side 22 so as to overlie and be in contact with the adhesive coating 14. The surface of the backing sheet 16 in contact with the adhesive coating 14 is coated with a silicone release agent to permit the backing sheet 18 to be easily removed therefrom.

To utilize the unit 10, the backing sheet 16 is initially removed from the unit 10. The backing sheet 16 is simply peeled from the adhesive coating 14 by separating a corner of the sheet 16 from the coating 14 and pulling the corner thereacross. The photograph is then centered over the panel 12 and placed in contact with the adhesive coating 14 so that the photograph suitably adheres to the unit 10. The panel side 20 is then addressed and stamped for mailing. Of course, an optional message can be applied to the panel region indicated 24.

If, after receiving the mounted photograph, the addressee desires to display it, he can either frame the photograph and unit 10 within a suitable frame or convert the unit panel 10 to an easel. The substantial planar configuration of the mounted photograph and unit permits the entire assembly to be suitably positioned within a frame, and the central and marginal portions 30 and 32, respectively, of the panel 12 are positionable relative to one another, as in the manner set forth above, to provide an easel.

An embodiment of the method of this invention includes the steps of constructing the unit 10. The relatively rigid panel 12, a suitable adhesive, and the releasable backing sheet 16 are initially provided. The adhesive is then layered over the panel marginal portion 32. The releasable backing sheet 16 is then substantially centered with the panel side 22 and placed into contact with the adhesive coating 14. The backing sheet 16 is thereby positioned in such relationship with the panel 22 that its boundary edges are substantially even with those of the panel 22.

In FIGS. 4–5, another embodiment of a unit, generally indicated 100, in accordance with the present invention is illustrated. The unit 100 includes a relatively rigid panel 112, a coating 114 of adhesive, a releasable backing sheet 116, and a border panel 118. The components of the unit 100 are assembled generally in a layered or layup arrangement with the border panel 118 bordering the backing sheet 116. The panel 112 is constructed of the same material out of which the panel 12 of the unit 10 of FIGS. 1–3 is constructed, the adhesive coating 114 is comprised of the same material out of which the coating 14 of unit 10 is comprised, and the backing sheet 116 is constructed of the same material out of which the backing sheet 16 of unit 10 is constructed.

The panel 112 is rectangular in shape and has boundary edge dimensions which are larger than the edge dimensions of the photograph to be mounted upon the unit 100. The panel 112 has a side 120 defining a surface which is adapted to receive a written message and another side 122 against which the coating 114 of adhesive is in contact.

The panel 112 defines a central tongue portion 130 and a marginal portion 132 bordering the central portion 130. Along a portion of the boundary of the central portion 130 is defined a series of cuts or slits 134,134, as shown. The slitted boundary of the panel central portion 130 can be easily separated from the panel marginal portion 132 to permit the central portion 130 and the marginal portion 132 to be folded relative to one another between a condition as shown in FIG. 4, at which the central portion 130 and marginal portion 132 are coplanar, to a condition at which the central portion 130 extends angularly away from the one side 120 of the panel 112. It will be understood that the central portion 130 is of such size and shape that when folded relative to the marginal portion 132 so as to extend angularly therefrom, the central portion 130 and marginal portion 132 collectively provide an easel.

The coating 114 of adhesive is layered upon the other side 122 of the panel 112 so as to cover a substantial portion of the panel marginal portion 132. As shown in FIG. 4, the adhesive coating 114 extends from the boundary of the central portion 130 to the boundary edges of the panel 112. No adhesive overlies the central portion 130.

The border panel 118 overlies the adhesive coating 114 and is comprised of a paper stock or card material having a rectangular-shaped boundary and a rectangular central cutout 138. A paper stock having a thickness of about 5 mills has been found to be well-suited for use as the border panel 118. The boundary edge dimensions of the border panel 118 are substantially the same as those of the panel 112 so that its peripheral edges are substantially even with the edges of the panel 112. The cutout 138 is substantially centered between the boundary edges of the border panel 118 and its peripheral edge dimensions are substantially the same as, but no less than, the edge dimensions of the photograph to be mounted upon the unit 100.

The releasable backing sheet 116 has boundary edge dimensions which are substantially the same as the peripheral edge dimensions of the central cutout 138 of the border panel 118, and as best shown in FIG. 5, is positioned centrally within the cutout 138 so as to overlie and to be in contact with a portion of the adhesive coating 114 bounded by the peripheral edges of the cutout 138.

To utilize the unit 100, the backing sheet 116 is initially peeled from the adhesive coating 114 by separating a corner of the sheet 116 from the coating 114 as shown in FIG. 5 and pulling the corner thereacross. A photograph is then centered within the cutout 138 and placed in contact with the exposed portion of adhesive coating 114 so that the photograph suitably adheres to the unit 100. The unit 100 can then be prepared for mailing as in the manner of a postcard.

The aforedescribed unit 100 is advantageous in that its border panel 118 provides a mat for the mounted photograph. Thus, whether displayed with the unit 100 within a suitable frame or by the unit panel 112 when placed in the form of an easel, the photograph needs no additional mat for the attractive display thereof.

An additional advantage of the unit 100 relates to the size of the border panel cutout 138 in relation to the photograph desired to be mounted. More specifically, the peripheral edge dimensions of the cutout 138 are at least as large as those of the photograph so that the photograph can be positioned therein so as to be totally viewable. This advantage is readily appreciated when the unit 100 is compared to a conventional unit having a photograph-viewing area which is smaller than the photograph to be mounted thereon. In such a conventional unit, a portion of the mounted photograph is necessarily hidden from view. On the other hand, when a photograph is operatively mounted upon the unit 100, no area of the photograph is hidden from view.

Another embodiment of the method of this invention includes the steps of constructing the unit 100. The relatively rigid panel 112, a suitable adhesive, the releasable backing sheet 116 and the border panel 118 are initially provided. The adhesive is then layered over the panel side 122 so that an adhesive coating 114 covers a substantial portion of the panel marginal portion 132. The border panel 118 is then placed into contact with the adhesive coating 114 so that the border panel 118 and panel 112 adhere to one another and into such relationship with the panel 112 so that its boundary edges are substantially even with those of the panel 112. The backing sheet 116 is then placed centrally within the border panel cutout 138 and into contact with the adhesive coating 114.

It will be understood that numerous modifications and substitutions can be had to the aforedescribed embodiments without departing from the spirit of the invention. For example, although each of the coating 14 or 114 of adhesive has been described as a single layer having a surface in contact with corresponding panel 12 or 112 and another surface for engaging a photograph, the coating of adhesive can be provided by one side of a double-backed tape, or bonded paper. Such a tape includes a thin sheet of flexible material and a layer of adhesive on each side of the sheet. If substituted for the coating 14 of the unit 10 of FIGS. 103, for example, the adhesive layer on one side of the tape adheres to the panel 12 and the adhesive layer on the other side of the tape provides the adhesive coating for engaging the photograph.

Furthermore, the dimensions of the boundary edges of the relatively rigid panel or the peripheral edges of a border panel may vary between units in order to accommodate photographs of various sizes.

Still further, the step of coating included in the aforedescribed embodiments of the method of this invention can include the steps of providing double-backed tape and placing one side thereof against the corresponding panel side. The adhesive coating is thereby provided by the adhesive layer on the other side of the tape. Thus, the aforedescribed embodiments are intended for purposes of illustration and not as limitation.

I claim:

1. A postal card assembly for mailing and displaying a photograph, said assembly comprising:

a relatively rigid panel of card material having a writing surface on one side thereof and including a central portion and a marginal portion, said relatively rigid panel being provided with a frangible tearline positioned along the perimeter of said central portion so as to permit said central portion to be separated by hand from the marginal portion and to be moved relative to the marginal portion between a first condition at which said central and marginal portions are coplanar and a second condition at which said central portion extends angularly from said one side of said relatively rigid panel, said central portion provided an easel;

a coating of a pressure sensitive adhesive layer upon the other side of said panel so as to cover no more than said marginal portion thereof so that when said photograph is operatively placed into contact with said other side of said panel, said central portion does not adhere to said photograph and said boundary portion can be separated by hand from said marginal portion as aforesaid for providing an easel; and a protective releasable backing sheet positioned in contact with said adhesive coating, and which is removed prior to positioning a photograph onto the panel.

* * * * *

UNITED STATES PATENT AND TRADEMARK OFFICE

CERTIFICATE OF CORRECTION

PATENT NO. : 4,947,566

DATED : August 14, 1990

INVENTOR(S) : Michael D. Hoebel

It is certified that error appears in the above-identified patent and that said Letters Patent is hereby corrected as shown below:

Column 6, lines 16, 18, 19, 24, 26 and 31:
In Claim 1 on lines 5, 7, 8, 13, 15 and 20 between the word "central" and "portion" insert --tongue--.

Column 6, line 22:
On line 11, in claim 1 after the word "central", insert the word --tongue--.

Column 6, line 33:
In claim 1, on line 22, delete the word "boundary" and substitute the words --central tongue--.

Column 6, line 30:
In claim 1, on line 19 delete the word "said" and substitute --a--.

Signed and Sealed this

Seventh Day of January, 1992

*Attest:*

HARRY F. MANBECK, JR.

*Attesting Officer*

*Commissioner of Patents and Trademarks*